US005850665A

United States Patent [19]

Bousset

[11] Patent Number: 5,850,665

[45] Date of Patent: Dec. 22, 1998

[54] CONTROL DEVICE FOR AN INTEGRATED SUCTION CLEANER UNIT

[75] Inventor: Serge Bousset, Fenols, France

[73] Assignee: Aldes Aeraulique, Venissieux Cedex, France

[21] Appl. No.: 893,659

[22] Filed: Jul. 11, 1997

Related U.S. Application Data

[63] Continuation of Ser. No. 532,763, Oct. 13, 1995.

[30] Foreign Application Priority Data

Apr. 13, 1993 [FR] France ..... 93/04588

[51] Int. Cl.[6] ..... A47L 5/38

[52] U.S. Cl. ..... 15/319; 15/314

[58] Field of Search ..... 15/314, 319, 339

[56] References Cited

U.S. PATENT DOCUMENTS

| | | | |
|---|---|---|---|
| 4,829,626 | 5/1989 | Harkonen et al. | 15/314 |
| 4,991,253 | 2/1991 | Rechsteiner | 15/319 X |
| 5,191,673 | 3/1993 | Damizet | 15/314 |

FOREIGN PATENT DOCUMENTS

| | | |
|---|---|---|
| 0 156 011 | 10/1985 | European Pat. Off. . |
| 0 399 931 | 11/1990 | European Pat. Off. . |
| 2 680 313 | 2/1993 | France . |
| 2 015 652 | 9/1979 | United Kingdom . |
| 88 02232 | 4/1988 | WIPO . |

*Primary Examiner*—Chris K. Moore
*Attorney, Agent, or Firm*—Hardaway Law Firm, P.A.

[57] ABSTRACT

The invention discloses a control device for an integrated suction cleaner unit (1) pneumatically connected to a system of tubes (13) which open, at their ends (13A), onto couplings (11) into which the mating end (9) of a hose (8) is inserted, the latter having at its other end (8A) a handle (5) onto which are fitted the cleaning accessories. The control device for the suction cleaning unit is of the type using acoustic transmission via the tube system (13) located between the suction cleaning unit (1) and the couplings (11) pressure wave detection (19, 23 and 28) for detecting specific acoustic pressure waves and controlling the suction cleaning unit (1). The positive pressure wave detection occurs when an acoustic pressure wave is generated when the hose (8) is connected to one of the suction cleaning couplings (11), and produces after handling, a specific acoustic wave conveyed by the tube system (13) to the detecting microphone (19) and pressure wave detection unit (23 and 28) controlling the suction cleaning unit (1). A negative pressure detection unit comprises a negative pressure switch (21), in the form of a tube (27) containing an orifice (20), a moveable core (26), and a compression spring (24), which detects negative pressure in the tube system (13), and controls the suction cleaning unit (1).

17 Claims, 2 Drawing Sheets

CONTROL DEVICE FOR AN INTEGRATED SUCTION CLEANER UNIT

This application is a file wrapper continuation of application Ser. No. 08/532,763, filed Oct. 13. 1995 now abandoned.

BACKGROUND OF THE INVENTION

1. Field of the Invention

This invention relates to a control device for an integrated suction cleaner unit which provides for an improved vacuum device.

The integrated suction cleaner unit is made up of an ensemble comprising pneumatically connected tubes, a microphone, an electronic pressure wave sensor, a dust container, an electric motor, a turbine, various electrical appliances for controlling the suction cleaning unit, and lastly suction cleaning couplings capable of receiving cleaning instruments.

The suction cleaning unit may be installed in a residential home maintenance room, garage, basement, or similar areas. The controlling suction cleaning unit is linked by a tube system to suction cleaning couplings carefully positioned in the zones to be cleaned. Each suction cleaning coupling is stopped by an articulated cover and may receive the extremity of a hose whose other extremity is fitted with a handle and a telescopic tube designed to receive various cleaning accessories such as brush, sucker, or tube extensions.

2. Description of the Prior Art

There are different devices for switching suction cleaning units on and off. The most commonly known system uses micro-contacts incorporated in suction cleaning couplings connected electrically by a low-voltage network to the control relay of the suction cleaning unit. The introduction of the extremity of the hose in one of the suction cleaning couplings activates the micro-contact which authorizes the supply of power to a relay which will switch on the electric motor of the suction cleaning unit, and the reverse maneuver being used to switch off the unit.

The disadvantage with the micro-contacts device is that it requires a relatively long amount of time during installation to connect the couplings electrically to the suction cleaning unit. The result is a costly installation process to which must be added the price of electrical fittings.

Another principle for control of suction cleaning units consists in using a radio-relay remote control in which the transmitter is placed on the handle of the hose and the receiver is placed close to the suction cleaning unit. The transmitter is controlled by activating a push button in the handle which triggers the transmitter. Among the many disadvantages of this device are:

- its cost,
- the position of the receiver on the hose handle which leaves it vulnerable to shock,
- the need to use electric batteries,
- the risk of switching on the suction cleaning unit accidentally by inadvertent pressure on the push button of the transmitter, without the hose being plugged into one of the suction cleaning couplings,
- serious problems of operation between the transmitter and the receiver placed near the suction cleaning unit (usually separated from the cleaning surface by several walls), requiring installers to offset this disadvantage by providing a receiver transposer at extra cost.

U.S. Pat. No. 5,191,673 to Damizet, describes a vacuum system which utilizes a pressure transducer located in the tube system to detect a pneumatic pressure wave. To switch on the vacuum system, a manual action on the handle of the hose pushes air through the tube system towards the suction cleaning unit which is fitted with a sensitive pressure switch. The suction cleaning unit is switched off after the handle is used to shut off the hose, thus causing an absence of flow in the system which triggers an articulated flap or valve, placed in the handle will close and a negative pressure electrical switch in the handle, will detect the absence of flow and the electrical switch will cut off electrical supply to the unit after a certain lapse of time. This principle requires a perfectly sealed pneumatic system, for the slightest air leak may upset the proper working of the suction cleaning unit. Too much escaping air may also attenuate the function of the pneumatic pressure wave in switching on the unit.

A last principle, described and represented in Patent PCT No 88.02232 under the name of ALLAWAY OY, consists in using a transmission by sound wave in the tubing to switch on the suction cleaning unit, by means of a transmitter installed in the handle of the hose and of a microphone installed near the suction cleaning unit. The internal sound wave propagates to the microphone which, after analyzing and recognizing said sound wave, will transmit a signal to switch on the electric motor relay of the suction cleaning unit. This transmitter comprises a push button which activates a loud-speaker supplying in output a sound wave on a frequency of the order of 16 Hz. Such embodiment has many disadvantages for it requires the use of an oversized loud-speaker and a considerable independent supply of energy, both incorporated in the handle, in order to provide a sound signal of such a frequency.

SUMMARY OF THE INVENTION

The device according to the invention makes it possible to remedy the prior art limitations while remaining reliable, inexpensive and capable of being installed on an existing or future system in a short amount of time.

The invention utilizes acoustic transmission of pressure waves via the tube system between the suction cleaning unit and the couplings, with the means for detecting the specific acoustic pressure wave by a microphone and a negative pressure switch. The suction cleaning unit is coupled to the suction hoses so that acoustic wave pressure is transmitted to the pressure wave detection unit, comprising a microphone, negative pressure switch, orifice in a tube containing an adjustable bolt and a spring, and an electronic sensor. The electric sensor is connected to the suction cleaning unit motor.

Thus, once the suction hose has been connected to one of the suction cleaning couplings, the mere fact of handling the suction hose is enough to produce a specific sound wave on a dominant frequency which will propagate in the pneumatic system up to the suction cleaning unit. At the suction unit end of the hoses, the detection unit detects a sound wave through a receiver fitted with a microphone-type sensor linked pneumatically to the suction system and electrically to a control logic which will control the switching on of the suction cleaning unit.

To switch off the suction cleaning unit, the control device of the invention comprises a means of interrupting suction flow through a quarter-turn valve constituted by an attachment, positioned near the handle and the hose. Positioned near the suction cleaning unit, a negative pressure detection and switch are located to detect the absence of flow with an increase in negative pressure, connected pneumatically to the tube system and electrically to a sensor linked to the electric relay of the motor which controls the suction cleaning unit. The control logic of the electronic sensors will control the suction cleaning unit to start up again after handling of the hose only after the turbine has come to a complete halt.

DETAILED DESCRIPTION

A first embodiment of the invention, consists of a means making it possible to detect the absence of flow with an increase of negative pressure in the tube system comprising of a tubular-shaped negative pressure switch with an orifice at its base and, inside, a core screwed onto a bolt, with the bolt resting on a compression spring. The negative pressure detection switch comprises a sensor electrically connected to the electric relay of the motor and capable of detecting in the tube at the level of a nearby orifice, the absence or presence of the core screwed into a bolt. Said negative pressure switch may be adjusted to adapt to the maximum possible negative pressure in the pneumatic tube system so that any unrepairable leak resulting from faulty installation may be tolerated without erroneous signals to the motor.

A second embodiment of the invention, consist of a means making it possible to detect the absence of flow with an increase of negative pressure in the tube system comprising use of a microphone for detection, of the sound wave produced by manipulation of the handle. When the suction cleaning unit is in operation, the microphone is also capable of detecting the difference in sound level caused in the tube system by an increase of negative pressure, providing a second signal to the electric relay of the motor to stop the motor unit, after a pre-determined time delay.

It is of course understood that these two means of detecting increased negative pressure in the pneumatic system may be used separately or together for greater security, by means of judicious adaptation of the control logic programming.

According to an advantageous characteristic of the invention, the adjustable negative pressure switch (21) with its core, bolt, and orifice sensor, plus the microphone for detecting the acoustic pressure wave and the increase of negative pressure in the system, and the control logic of the electronic sensor are all grouped together in a single detection unit. The detection unit is connected easily by means of a T-connection to said tube system. It should be noted that the control logic of the electronic sensor may also run a source of current, originating from the suction cleaning unit and usually designed to be connected to the suction cleaning couplings, said source, supplied by means of a connector outside the unit, facilitating the installation of the system since a single electric connection and two conductors are all that is required.

As a result, the control device of the invention has many advantages. In particular:

- it eliminates the need for any electric connection between the suction cleaning couplings and the unit,
- it may be installed on existing or future systems possessing leaks by default, thanks to the adjustable negative pressure switch or the microphone which is not affected by leaks,
- it can be adapted to most integrated suction installations available on the market,
- and finally, it can be installed easily and quickly by a non-specialist, at a lower cost than for most processes currently in use.

The principal aspects of the invention considered to be novel have been explained above. Further details concerning a preferred embodiment of the control device is referenced below and the accompanying drawings.

DESCRIPTION OF THE PREFERRED EMBODIMENT

Figure 1:
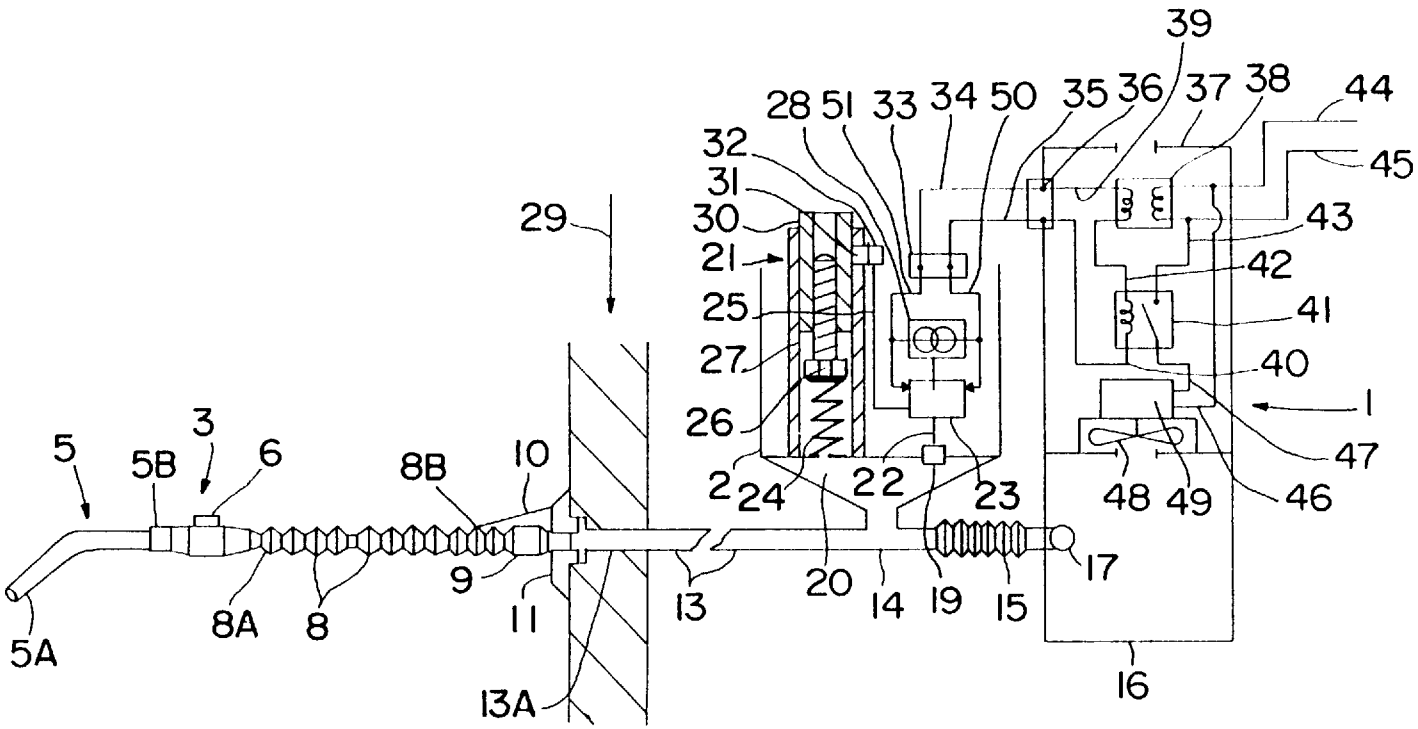
FIG. 1 is a schematic side view with partial cross sections representing the arrangement of the device according to the invention.

As represented in the drawing of FIG. 1, the suction cleaning unit globally referenced 1 and of the type most commonly found on the market, is fitted with a motor 49 controlled by a relay 41 to turn a turbine 48 so as to create a negative pressure in a case 16 and, by means of an orifice 17 made in said case, in the whole of the pneumatic tube system 13.

An anti-vibration connection hose 15 is very often placed between the tube system 13 and the case 16. The tubes 13 are, at their extremities 13A, connected to suction cleaning couplings 11, distributed in the cleaning zone, each coupling being fitted with a shutter 10 ensuring that the system 13 is airtight when closed.

A light, flexible hose 8 fitted with an end-piece 9 connects to one of the couplings 11 when the shutter 10 is opened. At the other end of the hose 8 is a handle 5 which may, in its extremity 5A, receive cleaning accessories.

According to the invention, this installation is equipped with a pressure wave detection control device for switching on or off the suction cleaning unit 1. The detection device comprises a detection unit 2, a coupling valve 3 a hose 8 and tubes 13 for transmission and detection of pressure waves.

The compact detection unit receiver 2 fits into a tee 14 for its pneumatic connection with the system 13. The detection unit is electrical attached to the connector 36 by the conductors 34 and 35, for its liaison to the electric part 37 of the suction cleaning unit 1. The suction cleaning unit 1 is switched on when the hose 8 with its end-piece 9 is introduced into the suction cleaning coupling 11 after opening of the shutter 10. Simply handling the hose 8 is enough to produce a sound wave on a specific frequency which, traveling across the tube system 13, arrives at a microphone-type sensor 19 which transmits the electrical signal, via its conductors 22, to all of the electronic components making up a control logic 23. After analyzing and recognizing the signal received by the microphone 19, the control logic 23 triggers on electrical current source 28 providing electrical current to the circuit constituted by the ensemble of conductors 50, 51, 34, 35, 39, 40 and 42 connected by means of connectors 33 and 36, so that the relay coil 41 of the suction cleaning unit 1 establishes, by means of its an electrical current passage to the conductors 45, 43 and 47 representing the phase of a 220 V main supply, the neutral being connected directly to the motor 49 by the conductors 44 and 46. The electric motor 49 of the turbine 48 then switches on to create a negative pressure in the case 16 and then, passing through the orifice 17, and throughout the tube system 13.

The current source 28 supplying the control logic 23 is connected to the low-voltage transformer 38 supplying the rely 41. It should be noted that the control logic 23 uses a very low current source for its operation, this source being capable of crossing the coil of the relay 41 without hindering its operation.

According to the invention, the suction cleaning unit 1 is switched off with means permitting the flow of air in the tube system 13 to be interrupted, and means permitting the detection of the absence of this air flow in the system.

Figure 2:
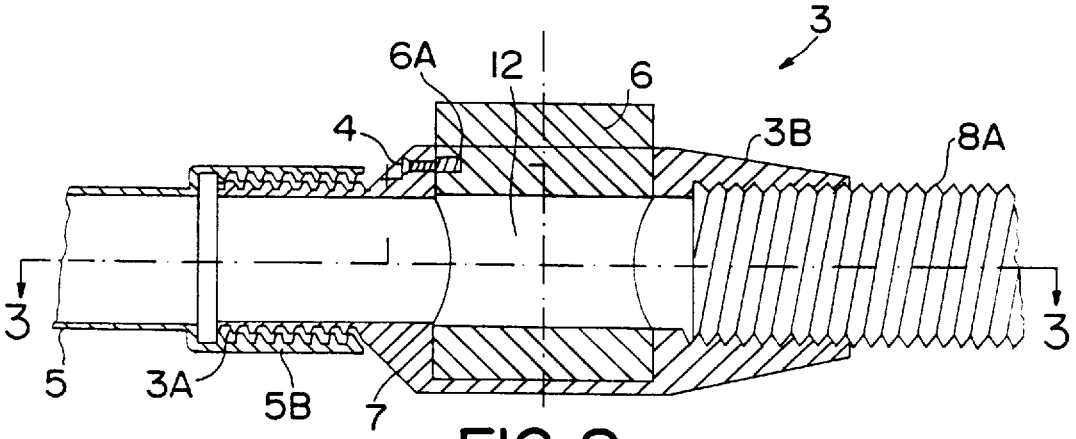
FIGS. 2 and 3 represent two arrangements of the valve with a side section view of the valve in operating position and an overhead view of the valve in the stop position.
Figure 3:
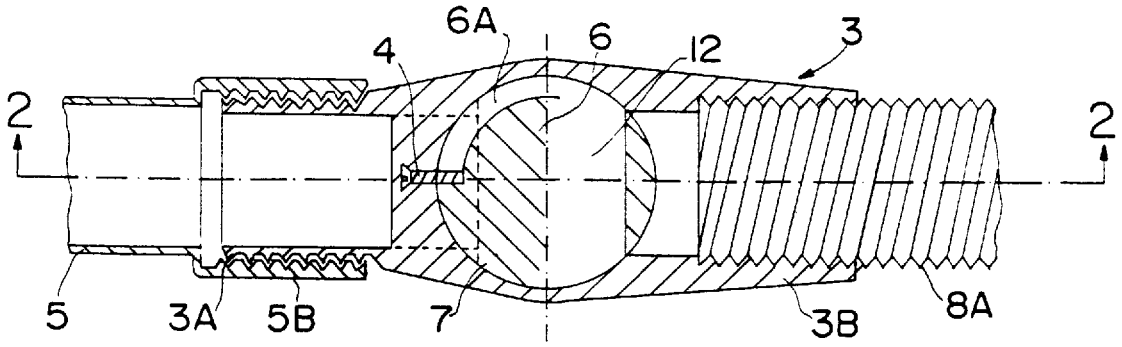

The means of interrupting the flow of air in the system 13 are made up of a valve 3 formed in an attachment linked with its sleeve 3B to the extremity 8A of hose 8 and with its sleeve 3A to the extremity 5B of handle 5. This valve, which is represented in detail in FIG. 2, has a housing 7 into which is inserted and adjusted a lever 6 provided with an orifice 12 corresponding to the inner diameter of the hose 8. A screw 4, maintained in valve 3 and overlapping in housing 7 is inserted in a groove GA provided in lever 6, on a quarter of the perimeter of said lever 6, thereby allowing, after a manual action of a quarter turn on lever 6, the flow of air to be authorized or interrupted throughout the pneumatic system 13.

The flow of air in the pneumatic system may also be interrupted by disconnecting the end-piece 9 of the suction cleaning coupling 11, after closing the shutter 10.

In both cases (by the valve 3 or by disconnecting the couplings 11), these actions will cause an increase of negative pressure in the pneumatic system 13, which may be detected in two ways.

In the first case, the detection of the absence of air flow with an increase of negative pressure in the tube system 13 may be detected by a negative pressure switch 21 which, associated with a sensor 32 connected to the control logic 23, consists of a tube 27 with an orifice 20 at its base and inside the tube 27, a core 30 screwed onto a bolt 26 resting on a compression spring 24. The increase of negative pressure in the tube system 13 is transmitted to the negative pressure switch 21, by orifice 20 in tube 27, by causing core 30 to move in the direction arrow 29 toward the spring which compresses spring 24 by means of the negative pressure adjustment bolt 26. The core 30 is moved in order to free an orifice 31 provided on the top of tube 27, thereby allowing said facing electronic sensor 32 to detect the absence of core 30 at this level and to transmit, via its conductors 25, an electrical signal to control logic 23 which will instruct source 28, after a pre-set interval of time, to cancel the electrical current passage in the circuit constituted by conductors 50, 51, 34, 35, 39, 40 and 42, which are linked up by connectors 33 and 36. The pre-set time interval in the control logic 23 for switching off the suction cleaning unit 1 is designed to avoid any untimely interruption of said unit, due to the temporary obstruction of the cleaning accessories in the course of normal use.

As a result, the coil of the control relay 41 activates its power contact towards the opening, causing the interruption of the electrical current passage in the circuit constituted by conductors 45, 43 and 47 of motor 49 of turbine 48. The turbine motor stops operating since it is no longer supplied by the phase but only by the neutral by means of conductors 46 and 44.

Next, as a result of the action of the return force of compression spring 24 and as the negative pressure decreases in the pneumatic circuit, core 30 of the negative pressure switch 21 climbs in the direction away from the spring (opposite to that of arrow 29) closing orifice 31 of tube 27 at the level of sensor 32 which then transmits, via its conductors 25, a new signal to the control logic 23. The new signal from control logic 23 enables the sensor-microphone 19, after a certain time delay (corresponding to when turbine 48 has come to a complete halt), to detect listen out for a new pressure signal for restarting the suction cleaning unit 1.

In the second case, when couplings 11 are disconnected and which may be the first case, the absence of flow with an increase of negative pressure in the tube system 13 may be detected by the sensor-microphone 19 which measures the difference of sound level produced inside tube system 13 by the variations of negative pressure. The microphone 19 will detect this difference of sound level and an electrical signal is sent to the control logic 23 which will program the cut-off of the supply circuit of the motor 49.

I claim:

1. A control device for an integrated suction cleaner installation comprising:

a suction cleaning unit (1) pneumatically connected to a system of tubes (13) which open at their ends (13A) onto couplings (11) onto which a mating end (9) of a hose (8) is inserted, the hose having at its other end (8A) a handle (5) suitable for receiving cleaning accessories;

said system of tubes (13) between the suction cleaning unit (1) and couplings (11), capable of transmission of acoustic pressure waves;

means for operating said suction cleaning unit (1);

means (19, 23 and 28) for detecting a specific acoustic pressure wave created by handling of the hose, and located within the system of tubes, said specific acoustic pressure wave detecting means adapted to signal said operating means;

means (21, 32) for detecting an increase of negative pressure in the tube system (13), said negative pressure detecting means adapted to signal said operating means;

wherein said means for operating said suction cleaning unit is activated when said specific acoustic pressure wave detecting means senses said specific acoustical pressure wave and said means for operating said suction cleaning unit is deactivated after said negative pressure detecting means senses said increase of negative pressure.

2. The control device according to claim 1, wherein said means for detecting an increase of negative pressure in the tube system (13) comprises a negative pressure switch (21), said negative pressure switch comprising a tube (27) provided with an orifice (20) at its base, a core (30) disposed inside said tube, said core connected to a bolt (26) resting on a compression spring (24) within said tube (27), said core (30) and said bolt (26) moving in said tube (27) from a second orifice (31) and a sensor (32), toward said orifice (20) at the base of said tube during an increase in negative pressure, said sensor (32) signalling said operating means when said core is not adjacent to said sensor (32).

3. The control device according to claim 2, wherein said means for detecting an increase of negative pressure in the tube system (13) further comprises said sensor (32) capable of detecting both the absence and the presence of said core (30) in the tube (27) at the level of the second orifice (31), said core moving in said tube (27) in relation to the absence of flow in said tube system (13).

4. The control device according to claim 3, wherein said handle (5) includes a valve (3) for selectively interrupting the flow of air in the tube system.

5. The control device as recited in claim 4, wherein said valve comprises:

a rotor element movably disposed within the handle for selectively interrupting a flow of air in the system, said rotor element including a an orifice (12) corresponding to an inner diameter of the hose and a groove (6A);

a lever connected to said rotor element and extending from the handle for moving said rotor element; and a projection secured to said handle and engaging said groove to limit rotation of the rotor element within the handle.

6. The control device according to claim 2 wherein said core (30) is threaded to accommodate said bolt (26), said bolt permitting adjustment of the height of said core (30) in relation to said second orifice (31).

7. The control device according to claim 2, wherein said means for detecting the absence of flow by detecting an increase of negative pressure in the tube system (13), further comprises a control logic (23) adapted to:

receive the signal transmitted by the sensor (32) of said negative pressure switch (21);

receive the signal transmitted by said specific acoustic pressure wave detecting means; and generate a signal to said operating means for stopping and restarting the suction cleaning unit (1) after a time delay from receiving the signal from one of the negative pressure switch and the specific acoustic pressure wave detecting means.

8. The control device according to claim 1, wherein said means for detecting a specific acoustic pressure wave transmitted by said tube system (13) and said means for detecting an increase of negative pressure in the tube system (13) comprise:

a control (23) logic for signalling said operating means;

a microphone (19) detecting the sound level in said system and transmitting a signal to said control logic (23) in response to the sound level, wherein said control logic detects a change in sound level in said system;

a negative pressure switch (21) detecting an increase of negative pressure in said tube system (13); and said negative pressure switch transmitting an electrical signal to said control logic (23) upon detecting the increase of negative pressure in said tube system (13).

9. The control device according to claim 8, further comprising a plurality of electrical conductors for transmitting electrical signals from said microphone and said negative pressure switch to said control logic (23) for controlling the operation of the suction cleaning unit (1).

10. The control device according to claim 8, wherein said microphone (19), said negative pressure switch (21), said control logic (23), and a current source (28) are grouped together in a single container (2) linked pneumatically to the tube system (13) and electrically to the suction cleaning unit (1).

11. The control device according to claim 10, wherein said control logic (23) receives:

the signal transmitted by the microphone (19) and the signal transmitted by the negative pressure switch (21) for controlling the operation of the suction cleaning unit (1), said signal received by said control logic (23); and said current source (28) associated with the suction cleaning unit (1), said current source providing electrical current to said control logic, said microphone, said negative pressure switch, and to a plurality of electrical conductors of said suction cleaning unit;

wherein said control logic produces time delay signals necessary for stopping and restarting the suction cleaning unit in response to said signals from said signals from said microphone and said negative pressure switch.

12. The control device according to claim 1, wherein said suction cleaning unit (1) further comprises a valve (3) for selectively interrupting a flow of air in the system.

13. The control device as recited in claim 12, wherein said valve comprises:

a rotor element movably disposed within the handle for selectively interrupting a flow of air in the system, said rotor element including a an orifice (12) corresponding to an inner diameter of the hose and a groove (6A);

a lever connected to said rotor element and extending from the handle for moving said rotor element; and a projection secured to said handle and engaging said groove to limit rotation of the rotor element within the handle.

14. The control device for an integrated suction cleaner as recited in claim 13, further comprising a means (3, 10) for generating an increased negative pressure in said suction cleaner.

15. The control device according to claim 1, wherein said means for detecting the specific acoustic pressure wave within the system of tubes (13) further comprises a control logic (23) for controlling said suction cleaning unit and for receiving:

a signal transmitted by a microphone (19) and a signal transmitted by a negative pressure switch (21), said signals transmitted by a plurality of electrical conductors to said control logic (23); and said control logic producing time delay signals necessary for stopping and restarting the suction cleaning unit (1); and a current source (28) associated with the suction cleaning unit (1), said current source providing electrical current to said control logic, said microphone, said negative pressure switch, and said electrical conductors of said suction cleaning unit;

wherein said control logic produces time delay signals necessary for stopping and restarting said suction cleaning unit in response to said signals from said microphone and from said negative pressure switch.

16. The control device according to claim 15 wherein said microphone (19), said negative pressure switch (21), said control logic (23), and said current source (28) are grouped together in a single container (2) linked pneumatically to the tube system (13) and electrically to the suction cleaning unit (1).

17. A control device for an integrated suction cleaner, said suction cleaner comprising: a suction unit (1); a tube (13) having a first end pneumatically connected to said suction unit, and a second end; a coupling (11) attached to said second end of said tube; and a hose (8) having a first end removably connected to said coupling, and a second end suitable for receiving cleaning accessories, the device comprising:

a means for operating said suction unit;

a means (19, 23, 28) for detecting the handling of said hose, said means for detecting the handling being operatively connected to said means for operating, and generating a signal when detecting the handling of said hose; and a means (21,32) for detecting an increase in negative pressure in said suction cleaner, said means for detecting an increase in negative pressure being operatively connected to said means for operating, and generating a signal when detecting the increase in negative pressure in said suction cleaner;

wherein said means for operating activates said suction unit in response to the signal from the means for detecting the handling, and deactivates said suction unit in response to the signal from the means for detecting the increase in negative pressure.

* * * * *